US007338317B1

(12) United States Patent
Nagy

(10) Patent No.: US 7,338,317 B1
(45) Date of Patent: Mar. 4, 2008

(54) PANEL-MOUNTED CONNECTOR

(75) Inventor: Brian Nagy, Woodhaven, MI (US)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/580,331

(22) Filed: Oct. 12, 2006

(51) Int. Cl.
*H01R 13/73* (2006.01)

(52) U.S. Cl. ..... 439/555

(58) Field of Classification Search ..... 439/555, 439/557, 553, 558, 247
See application file for complete search history.

(56) References Cited

U.S. PATENT DOCUMENTS 5,249,982 A * 10/1993 Funck et al. ..... 439/556
5,259,788 A * 11/1993 Nishimura et al. ..... 439/565
5,299,949 A * 4/1994 Fortin ..... 439/275
5,588,858 A * 12/1996 Lester et al. ..... 439/275
5,613,876 A * 3/1997 Sakatani et al. ..... 439/552
5,895,289 A * 4/1999 Smith ..... 439/553
6,860,759 B2 * 3/2005 Nakamura et al. ..... 439/557
6,945,816 B1 * 9/2005 Wu ..... 439/545
2004/0266256 A1 * 12/2004 Bosco ..... 439/557
2006/0094293 A1 * 5/2006 Daggett et al. ..... 439/544

* cited by examiner

*Primary Examiner*—Tulsidas C. Patel
*Assistant Examiner*—Vladimir Imas
(74) *Attorney, Agent, or Firm*—Gerald E. Hespos; Anthony J. Casella

(57) ABSTRACT

A panel connector is provided for mounting in an aperture through the panel. The connector includes a housing with a front end dimensioned and configured to pass through the aperture in the panel. A resiliently deflectable clip is mounted to the housing and has a panel lock that deflects during mounting of the housing onto the panel. The panel lock then returns resiliently to engage the panel when the housing is mounted. A CPA piece is pre-assembled to the clip at a pre-staged position that permits the clip to deflect during mounting on the panel. The CPA piece then is pushed to a final lock position for preventing deflection of the clip.

10 Claims, 11 Drawing Sheets

PANEL-MOUNTED CONNECTOR

BACKGROUND OF THE INVENTION

1. Field of the Invention

The invention relates to an electrical connector that can be mounted to a substantially rigid panel, such as a panel in an automotive vehicle.

2. Description of the Related Art

Automotive vehicles and other electromechanical devices have substantially rigid panels that separate one part of the vehicle or apparatus from another. For example, a rigid panel separates the passenger compartment of a vehicle from the engine compartment. Rigid panels also separate the various electromechanical components in a vehicle door from the exterior of the door.

The typical automotive vehicle will include hundreds of meters of wires for delivering power and transmitting signals between the many electrical and electronic devices in a vehicle. The wires are grouped together into complex arrays of harnesses, many of which must pass through panels in a vehicle. In some instances, a wire harness may pass through a grommet that can be mounted in an aperture in a panel of a vehicle. In other instances, however, the wires of a harness are mounted in a connector and the connector in turn is mounted to the panel. The panel-mounted connector then can be mated with another connector that may be part of a different wire harness.

A panel-mounted connector and its associated wiring harness may be assembled into a sub-component of a vehicle, such as a vehicular door. The sub-component will be transported in a partly assembled condition to another location in the vehicular manufacturing facility where the sub-component can be assembled with other parts of the vehicle. Many electrical circuits in a vehicle are very important parts of the safe and efficient operation of the vehicle. As a result, vehicular manufacturers generally require tests to be performed during the manufacturing process to ensure that all circuits have been assembled correctly and work for their intended purpose. Additionally, vehicles invariably are used in high vibration environments. As a result, vehicle manufacturers typically require secure and often redundant locking of parts of an electrical system that conceivably could be separated from one another. Many locks are configured to provide a position assurance check. The position assurance device will not seat properly if the associated terminal fitting is not mounted properly in the housing or if the associated housing is not mounted properly on a panel. Improper or incomplete mounting of the position assurance member generally will prevent completion of a subsequent step in the assembly, thereby providing a clear indication that the assembly must be rechecked.

A typical panel-mounted connector is identified by the numeral 100 in FIGS. 1 and 2. The prior art connector 100 includes a resin housing 102 with opposite front and rear ends 104 and 106 and a plurality of cavities 108 extending between the ends. Terminal fittings (not shown) are connected to ends of wires and are mounted in the respective cavities 108 in a rear-to-front direction so that the wires extend from the rear end 106 of the housing 102. Locks 110 are formed in the cavities 108 and/or on the terminal fittings so that the terminal fittings are locked in specified positions within the cavities 108. Many connectors also include retainers to assure proper positioning of the terminal fittings in the cavities and to lock the terminal fittings redundantly in the cavities.

The housing 102 of the panel-mounted connector 100 is configured to be mounted to a panel P, such as a panel in an automotive vehicle or apparatus. The panel P has opposite front and rear surfaces F and R, and a mounting aperture A extends through the panel P from the front surface F to the rear surface R. The mounting aperture A is configured to receive the front end 104 of the housing 102. However, a flange 112 projects out from the housing 102 at a location spaced from the front end 104 to limit the insertion of the front end 104 of the housing 102 through the mounting aperture A in the panel P. A rib 114 typically extends out from one side of the housing 102 at a location forward of the flange 112. The distance between the rib 114 and the flange 112 is selected to exceed the thickness of the panel P. A metal clip 120 is mounted to a side of the housing 102 opposite the rib 112 so that a front portion 122 of the metal clip 120 projects forward of the flange of the housing.

This known housing 102 is mounted to the panel P by first inserting the rib 114 of the housing 102 through a portion of the aperture A in the panel P from the rear side R of the panel P. Thus, a portion of the panel P will be trapped between the rib 114 and the flange 112 with the rib 114 on the forward side of the panel P, but with most of the rest of the housing 102 rearward of the panel P. The front end 104 of the housing 102 then is rotated forwardly relative to the panel so that the remainder of the front end 104 of the housing 102 passes through the aperture A in the panel P. Sufficient rotation will urge the metal clip 120 into engagement with the panel P at a position opposite the rib 114. The clip 120 will deform resiliently and pass through the aperture A. However, the clip 120 will resiliently return to an undeformed condition when the housing 102 is properly mounted to the panel P. As a result, the flange 112 will engage against the rear surface R of the panel P outwardly from the aperture A in the panel P. The rib 114 and the metal clip 120, however, will engage the front surface F of the panel P to hold the housing 102 in position.

As noted above, the panel P often is part of a sub-assembly of a vehicle. The connector 100 is mounted to the panel P at the manufacturing location for the sub-assembly. The sub-assembly then may be transported to a different location in the manufacturing facility so that the sub-assembly can be mounted to the remainder of the vehicle.

The panel-mounted connector 100 and its wiring harness often will be tested electrically prior to completing the mounting of the sub-assembly onto the remainder of the vehicle. This testing is carried out by urging a connector of a testing apparatus into engagement with the terminal fitting in the cavities 108 of the panel-mounted connector 100. Corrections or replacements may be necessary if the test is not positive. These corrective measures may require the metal clip 120 to be deflected sufficiently so that the connector 100 can be separated from the panel P. Most such electrical tests will show that the connector 100 was assembled properly. As a result, a separate connector position assurance (CPA) piece 126 will be mounted on the housing 102 adjacent to the metal clip 120. The CPA piece 126 prevents the metal clip 120 from being deflected sufficiently to permit disengagement of the housing 102 from the panel.

A mating connector then may be mated with the front end of the panel-mounted connector 100. The mating connector may be configured to cover the CPA piece 126 to prevent inadvertent separation of the CPA piece 126. Additionally, the mating connector and/or the CPA piece 126 may be configured to prevent proper mating if the CPA piece 126 is not seated properly. Thus, an ability to complete a mating connection is a test for proper seating of the CPA piece 126.

The above-described prior art connector 100 generally works very well. However, there are a few potential problems. First, the metal clip 120 is not very large and may not hold the connector 100 adequately on panel P prior to proper seating of the terminal position assurance piece. As a result, the connector 100 can be separated from the panel P due to inadvertent contact with the housing or due to forces created while the electrical test is being carried out. As a result, the assembly operation must be delayed while the disengaged connector 100 is retrieved and mounted properly onto the panel.

Second, the separate CPA piece 126 requires the assemblers to maintain a distinct inventory of parts at the assembly location. These small parts then must be oriented properly and inserted properly into a position on the housing 102. An improperly oriented CPA piece 126 may not perform its intended function. Additionally, the assembly worker easily can drop the small CPA piece 126, thereby creating the potential for these CPA pieces 126 to be scattered on the floor of the assembly location. Assembly workers may not be highly skilled, highly paid or highly motivated. As a result, a worker could neglect to insert the CPA piece 126. An improperly mounted CPA piece 126 might impede a mating connector. However, the complete absence of a CPA piece 126 generally will not impede the mating connection. As a result, there is a significant potential that a connector 100 will not be mounted securely to a panel P due to an omission by the assembler.

In view of the above, it is an object of the subject invention to provide a panel-mounted connector with an enhanced connector position assurance.

It is another object of the subject invention to provide a panel-mounted connector that does not require a separate inventory of connector position assurance pieces.

A further option of the subject invention is to provide a panel-mounted connector that is not easily separable from the panel prior to locking the connector position assurance piece in place.

SUMMARY OF THE INVENTION

The invention relates to a panel-mounted connector for mounting to a rigid panel, such as a sheet metal panel in an automotive vehicle. The panel includes opposite front and rear faces and a mounting aperture extends through the panel from the front face to the rear face.

The connector includes a housing formed from a synthetic resin or other non-conductive material. The housing has opposite front and rear ends and at least one cavity extends through the housing from the front end to the rear end. The cavity is configured to receive a terminal fitting that may be connected to a wire or cable. A resiliently deflectable lock may be formed in each cavity and may be configured to lock the terminal fitting at a proper position in the respective cavity. Alternatively, the terminal fitting may be formed with a resiliently deflectable lance that engages a rigid structure in the housing to lock the terminal fitting at a specified position. A flange preferably projects out from the outer periphery of the housing at a position rearward of the front end. Portions of the housing near the front end are configured to pass through the aperture in the panel. However, the flange of the housing is cross-sectionally larger than the aperture in the panel and will limit the extent of insertion of the housing into or through the aperture in the panel.

At least one rib may project out from the outer periphery of the housing at a location near the front end and forward of the flange. A distance between the rib and the flange preferably is equal to or slightly greater than the thickness of the panel. With this configuration, the rib can be inserted in a rear-to-front direction through the aperture in the panel so that a portion of the panel is engaged between the rib and the flange of the housing. The housing then can be rotated so that portions of the front end of the housing opposite the rib approach the rear face of the panel and then pass through the aperture in the panel. Movement of the front end of the housing into the aperture will be limited by the flange.

A metal clip is mounted to the housing at a position spaced from the rib, and preferably a position substantially opposite the rib. The metal clip includes a rear end that is locked in a fixed position relative to the housing and a resiliently deflectable front end that is near the front end of the housing. The front end of the clip and the housing preferably define a cross-section that exceeds the cross-sectional dimension of the aperture in the panel when the clip is in an unbiased condition. However, the front end of the clip can be deflected so that the clip and adjacent parts of the housing can pass through the aperture in the panel. The clip will return resiliently towards an undeflected condition when the housing is mounted properly in the aperture of the panel. As a result, the clip will engage the front surface of the panel adjacent to the aperture to hold the housing in position on the panel.

The connector further includes a connection position assurance (CPA) piece that is mounted to the housing and/or to the clip before the housing is mounted to the panel. More particularly, the CPA piece preferably is mounted to the housing and the clip at a pre-staged position after the clip has been mounted to the housing. The CPA piece also is configured for movement from the pre-staged position to a fully locked position.

The CPA piece preferably is configured to permit limited deflection of the front end of the clip when the CPA piece is in the pre-staged position. The permitted deflection of the front end of the clip at the pre-staged position of the CPA piece is sufficient to permit the front end of the clip to pass through the aperture in the panel. However, the CPA piece in the pre-staged position preferably is configured to prevent an extensive deflection of the clip that could permit the entire housing to be separated inadvertently from the panel while the CPA piece is still in the pre-staged position.

The housing and the clip preferably can be moved relative to the CPA piece after the connector is mounted to the panel so that the CPA piece reaches the fully locked position relative to the housing and the clip. A portion of the CPA piece preferably is substantially adjacent the front end of the clip at the fully locked position, thereby preventing deflection of the clip that is required to separate the connector from the panel.

The CPA piece is part of the connector assembly, and hence does not require a separate inventory of small parts at the location where the vehicle or other apparatus is being manufactured and assembled. As a result, inventory control problems at the assembly site are avoided. Furthermore, the pre-staged mounting of the CPA piece on the housing prevents an inadvertent separation of the CPA piece at the assembly site, thereby avoiding the scattering of these small parts on the floor of the factory. Additionally, the pre-staged mounting of the CPA piece on the housing eliminates the potential for completely omitting the mounting of a CPA piece on the panel mounted connector. Furthermore, the pre-staged location of the CPA piece can prevent mating of the connector with another connector. Hence, an inability to complete mating of the connector and the mating connector provides a clear indication that the CPA piece has not been advanced into the fully locked condition.

DETAILED DESCRIPTION OF THE PREFERRED EMBODIMENT

Figure 1:
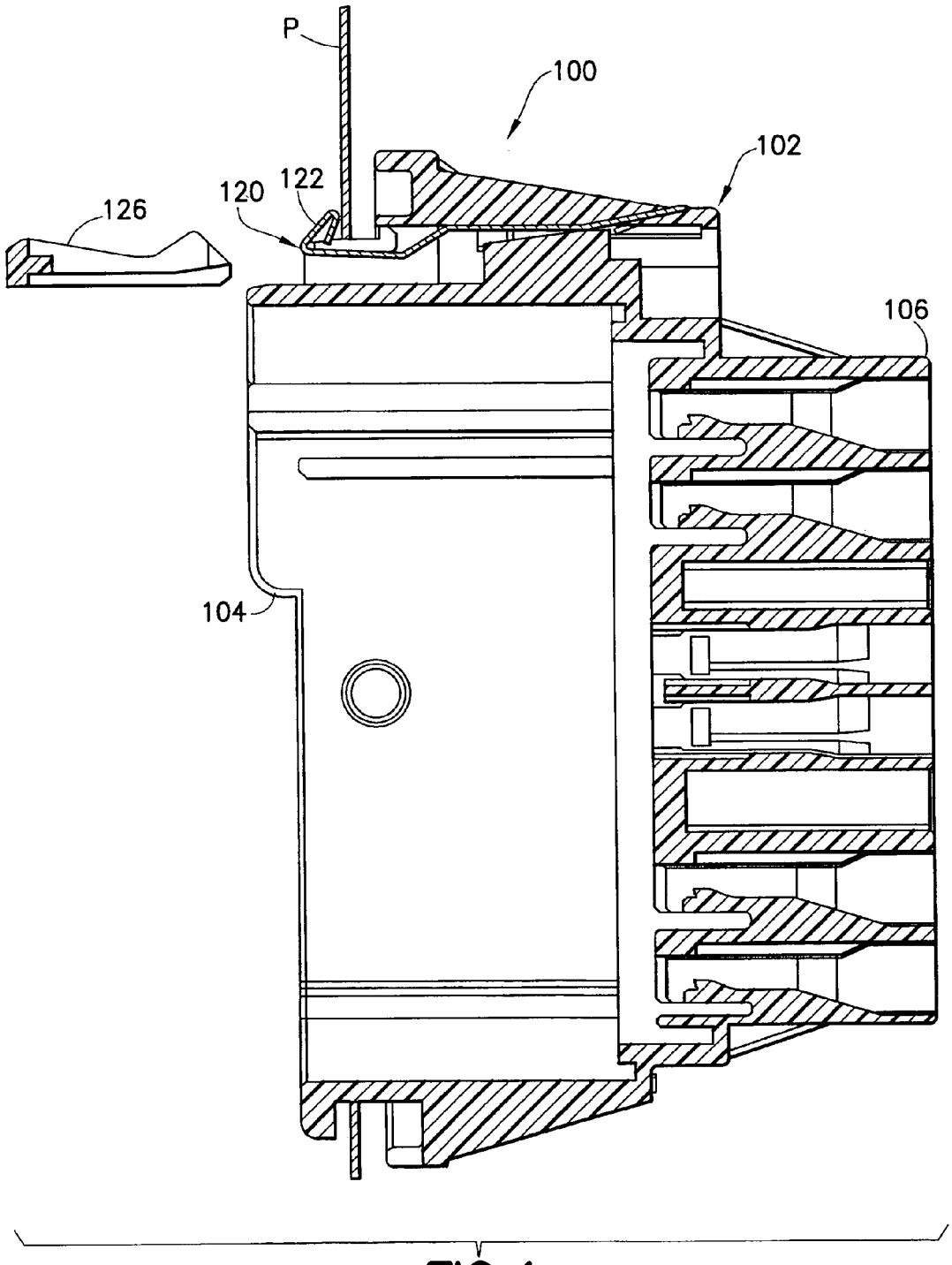
FIG. 1 PRIOR ART
FIG. 1 is an exploded cross-sectional view of a prior art panel connector prior to mounting the loose connector position assurance piece therein.
Figure 2:
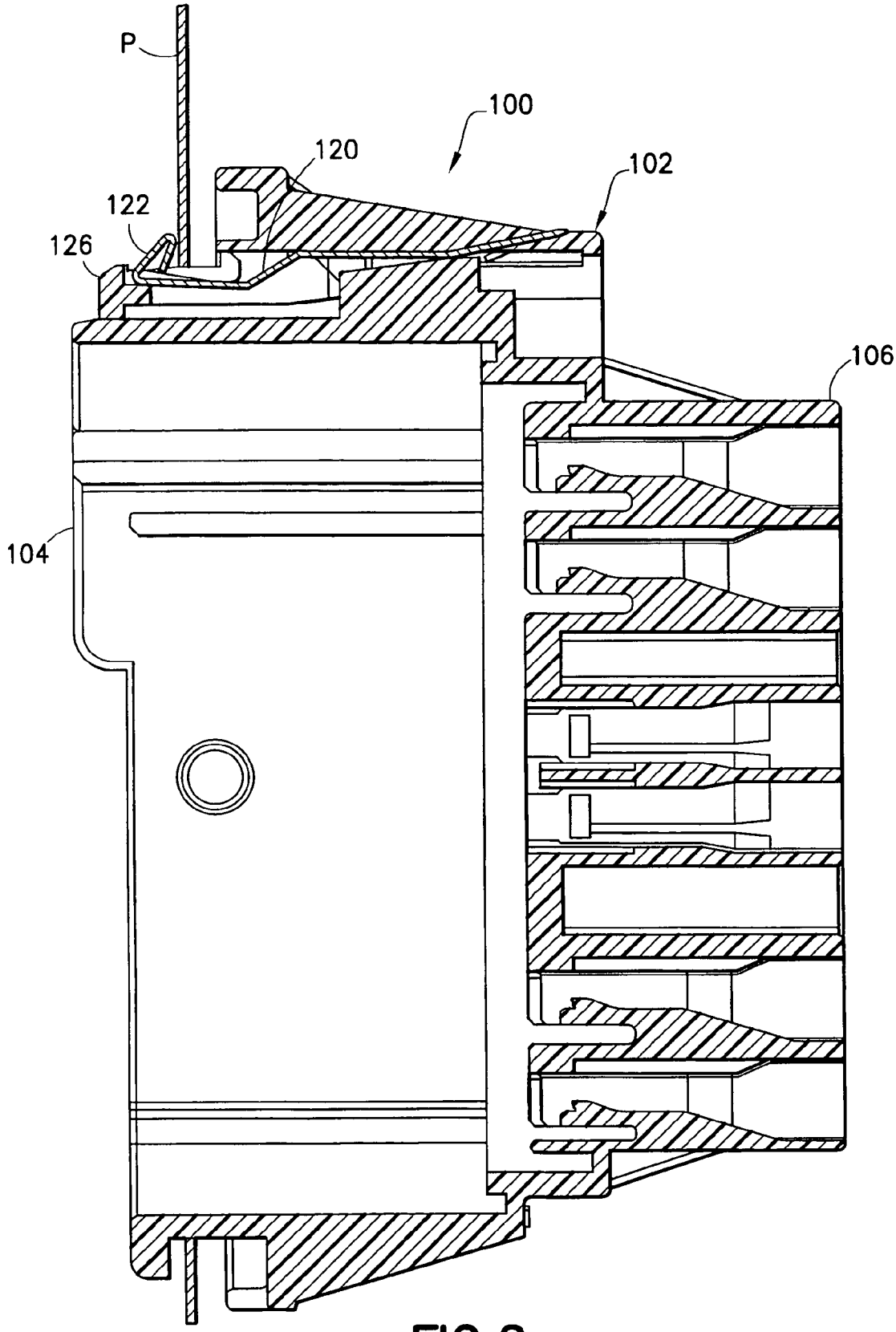
FIG.2 PRIOR ART
FIG. 2 is cross-sectional view of the fully assembled prior art panel connector.
Figure 3:
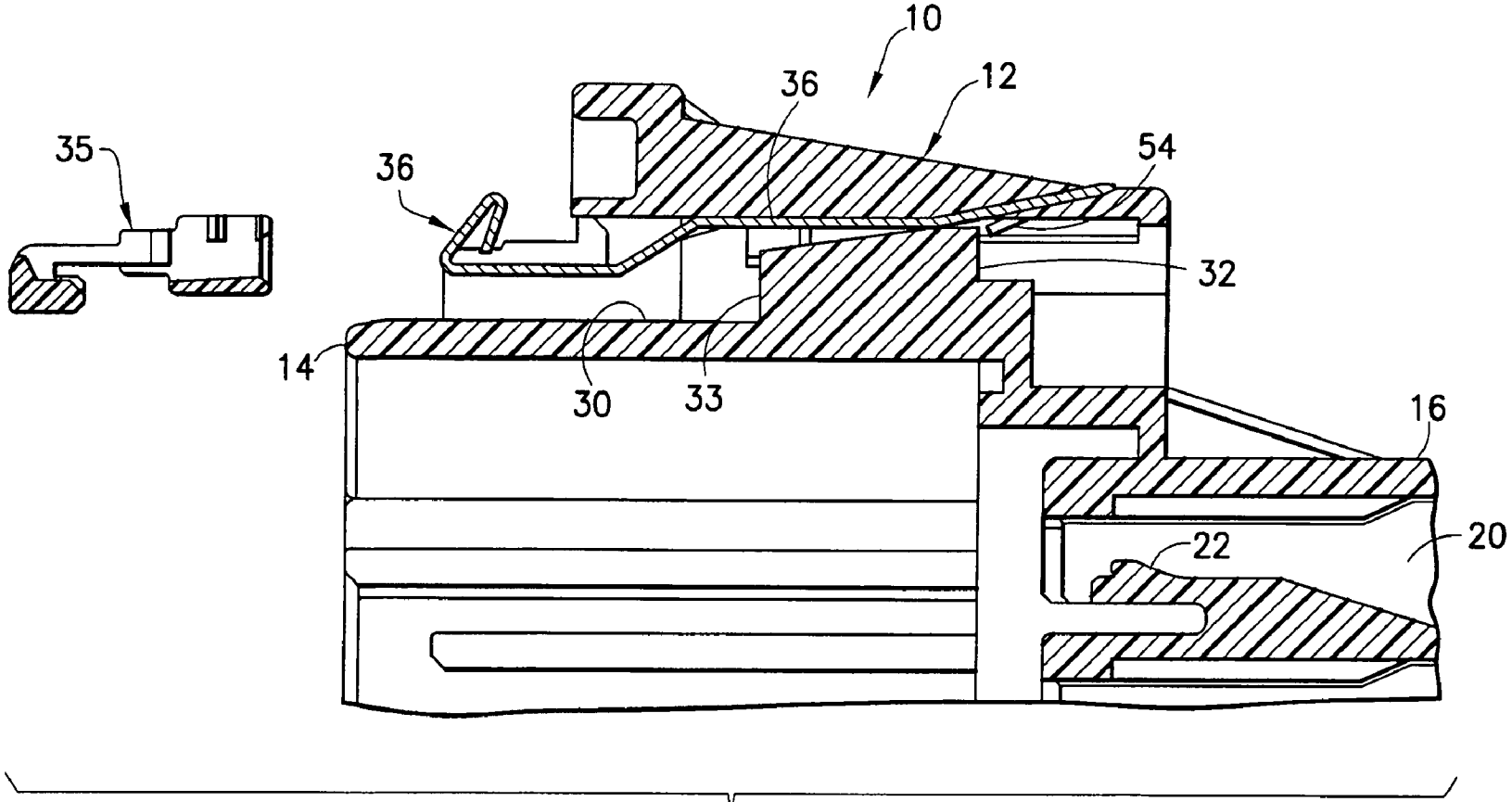
FIG. 3 is an exploded cross-sectional view of a panel connector in accordance with the subject invention.
Figure 4:
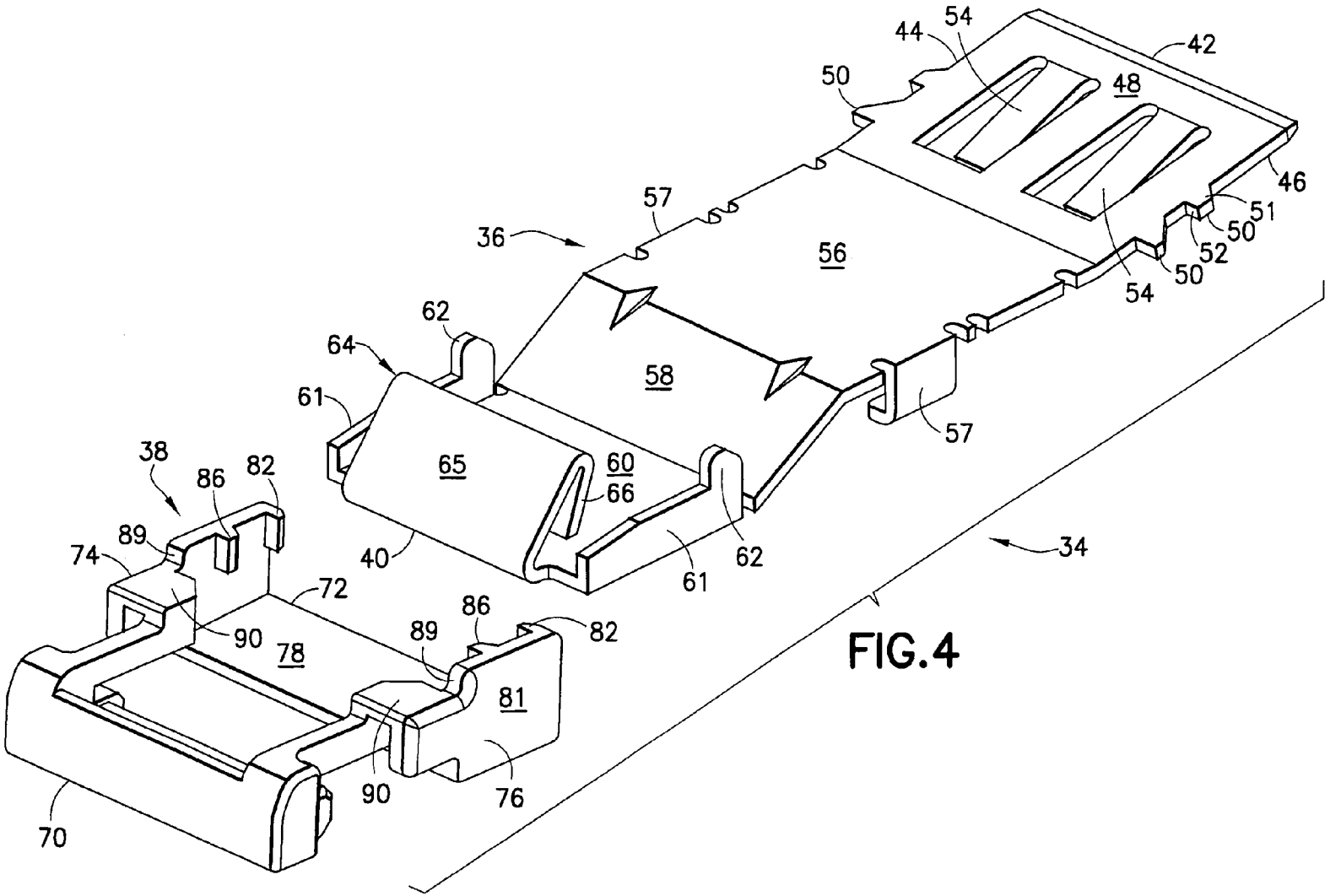
FIG. 4 is an exploded perspective view of the metal clip and connector position assurance piece of the subject invention.
Figure 5:
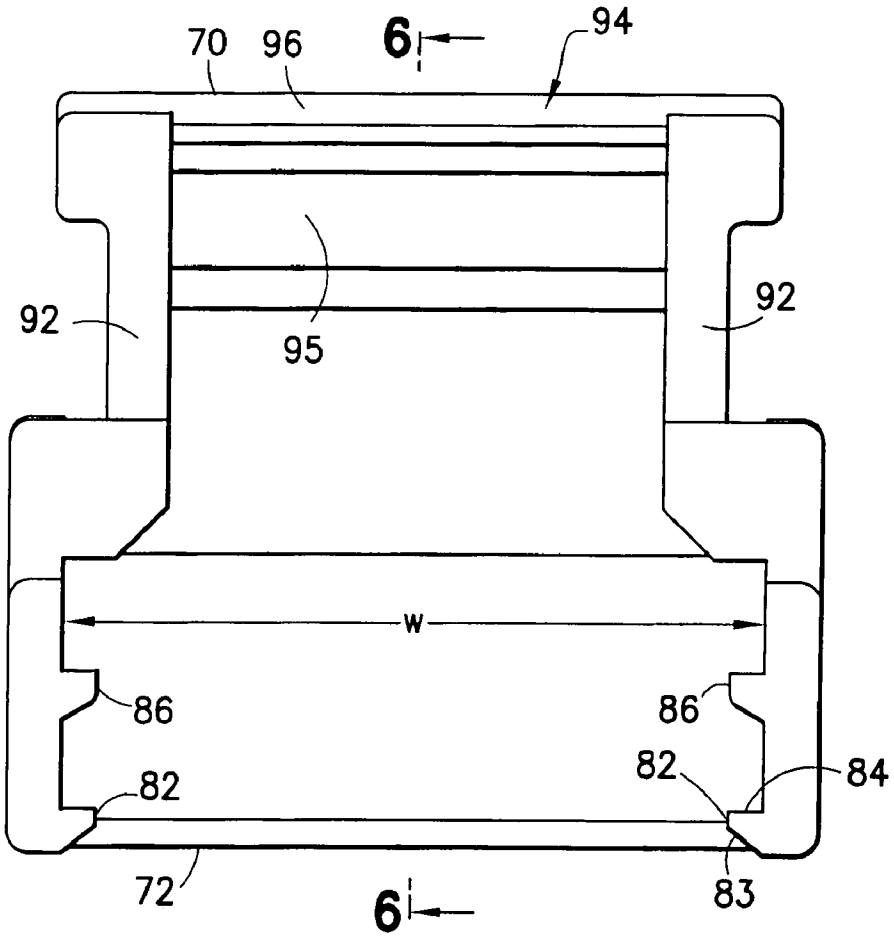
FIG. 5 is a top plan view of the connector position assurance piece.
Figure 6:
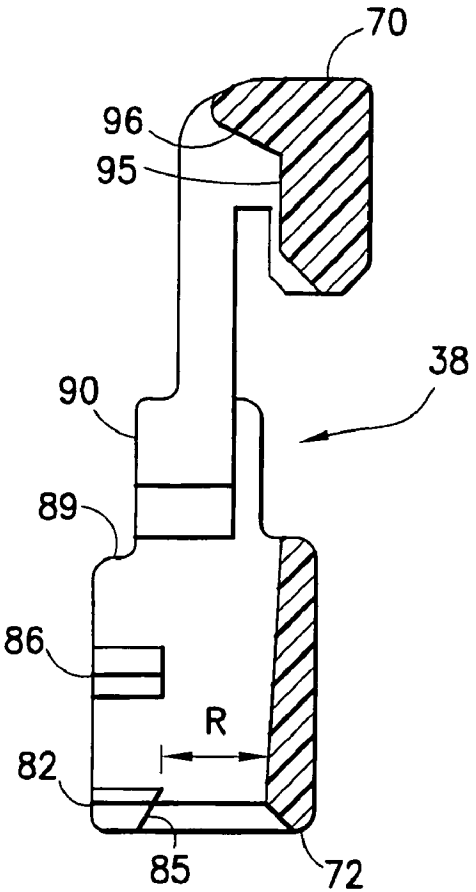
FIG. 6 is a cross-sectional view taken along line 6-6 in FIG. 5.
Figure 7:
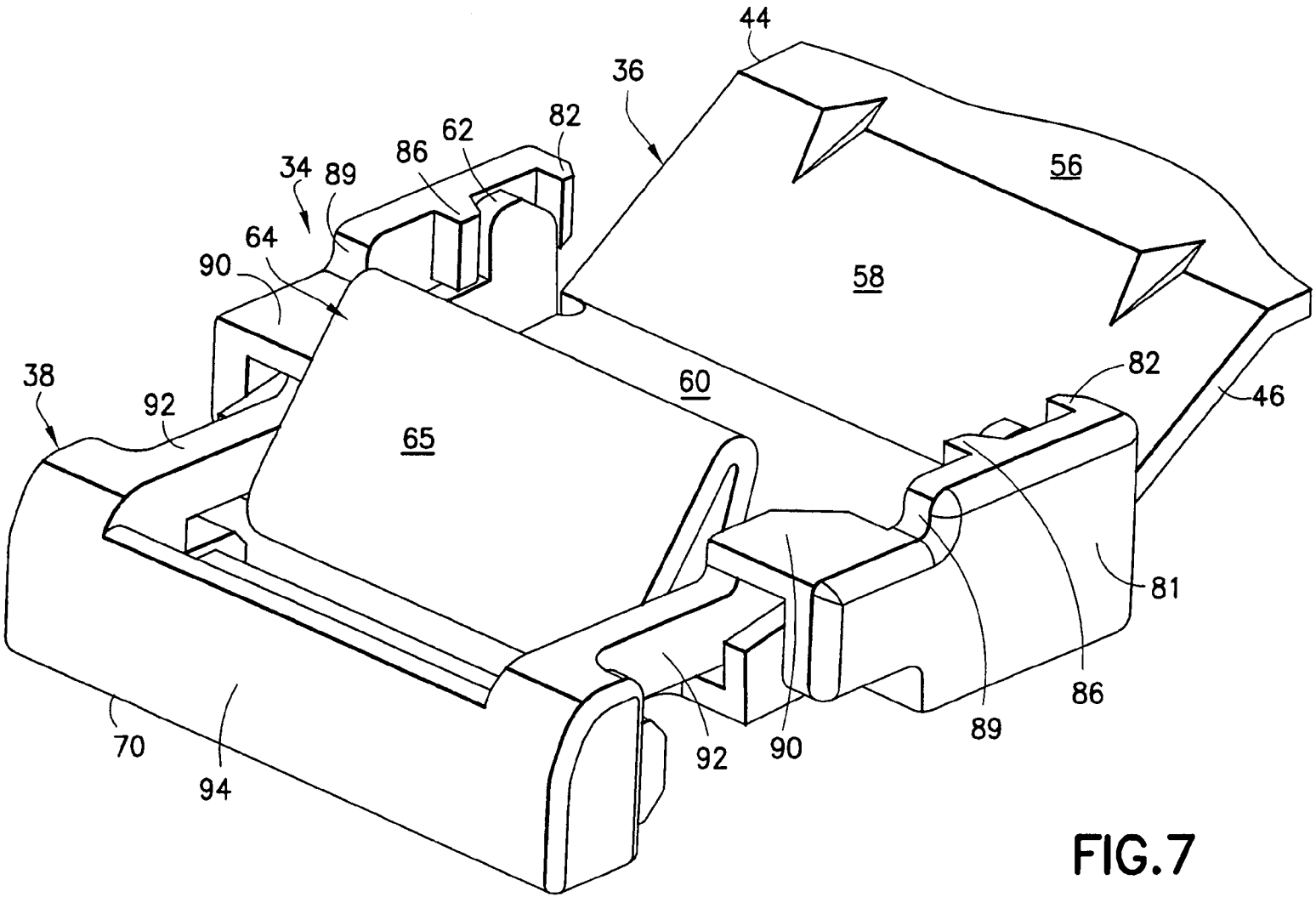
FIG. 7 is a perspective view of the connector position assurance piece assembled to the metal clip at a pre-staged position.

A panel connector in accordance with the invention is identified generally by the numeral 10 in FIGS. 3 and 8-11. The connector 10 is intended for mounting on a panel P, such as a sheet metal panel of an automotive vehicle. The panel P includes a rear face R, a front face F and an aperture A extending through the panel P from the rear face R to the front face F.

The connector 10 includes a housing 12 that preferably is molded unitarily from a non-conductive synthetic resin. More particularly, the housing 12 includes a front end 14 and a rear end 16. A receptacle 18 extends rearwardly into the front end and is configured for receiving a mating connector (not shown). Cavities 20 extend forwardly into the rear end 16 of the housing 12 and communicate with the receptacle 18. Each cavity 20 is configured to receive a terminal fitting (not shown). The terminal fittings are inserted into the respective cavities 20 in a rear-to-front direction so that wires connected to the terminal fitting extend rearwardly from the housing 12. Each cavity includes a resiliently deflectable lock 22. The locks deflect as the terminal fittings are inserted into the cavities 20. However, the locks 22 resiliently return to an undeflected condition after the terminal fittings have been inserted completely. As a result, the locks 22 securely hold the respective terminal fittings in the cavities 20.

The overall size and shape of the housing 12 is dictated by the number and sizes of the terminal fittings mounted in the housing 12. The aperture A in the panel P then is dimensioned and configured to receive portions of the housing 12 adjacent the front end 14. A flange 24 projects outwardly on the housing 12 at a location spaced rearwardly from the front end 14. The flange 24 extends completely around the periphery of the housing 12 and defines a cross-section that exceeds the cross-sectional size and shape of the aperture A through the panel P. A groove 25 is formed in the forwardly facing surface of the flange 24 and receives a seal (not shown) that can be engaged against the rear face R of the panel P. A rib 28 projects out from one peripheral edge of the housing 12 adjacent to the front end 14. The rib 28 is spaced forwardly from the flange 24 by a distance that exceeds the thickness of the panel P.

A channel 30 is formed in an outer peripheral portion of the housing 20 at a position substantially opposite the rib 28. The channel 30 extends from the front end 14 of the housing 12 to an exposed position forward of the rear end 16. Additionally, the channel 30 is disposed inwardly of the flange 24. The channel 30 is crQss-sectionally smaller at more rearward positions and a rearwardly facing locking surface 32 is formed on the housing 12 adjacent the channel 30 and near the rear end of the channel 30. A forwardly facing pushing surface 33 is formed in the channel 30 forward of the locking surface 32.

The channel 30 is configured to slidingly receive a locking assembly 34 that includes a clip 36 and a connector position assurance (CPA) piece 38 as shown more clearly in FIGS. 4-7.

The clip 36 is formed unitarily from a resilient piece of metal that is configured to be slid into the channel 30 of the housing 12. More particularly, the clip 36 includes opposite front and rear ends 40 and 42 and opposite side edges 44 and 46. The side edges 44 and 46 are spaced from one another by a distance corresponding to the width of the channel 30 in the housing 12 so that the clip 36 can be slid into the channel 30. A substantially planar locking panel 48 is formed adjacent the rear end 42 of the clip 36. Locking teeth 50 project out from the side edges 44 and 46 on the locking panel 48. The locking teeth 50 define a width that exceeds the width of the rear end of the channel 30. Each locking tooth 50 has a sloped front edge 51 to facilitate insertion of the clip 36 into the channel 30. However, each locking tooth 50 further has a rear edge 52 aligned substantially normal to a front-to-rear direction. The rear edges 52 of each locking tooth 50 will engage in the resin of the housing 12 adjacent to the channel 30 to impede a forward removal of the clip 36 from the channel 30.

Two U-shaped cuts 53 are formed in the locking panel 48 to define forwardly cantilevered locking fingers 54. The locking fingers 54 are bent to extend down from the plane of the locking panel 48 in an unbiased condition. The locking fingers 54 will deflect up into the plane of the locking panel 48 as the clip 36 is inserted into the channel 30. However, the locking fingers 54 will resiliently return to the orientation shown in FIG. 4 when the clip 36 is mounted fully in the channel 30. As a result, the front edges 55 of the respective locking fingers 54 will engage the locking edge 32 formed on the housing 12 adjacent to the channel 30.

A guide panel 56 is disposed forwardly of the locking panel 48 and will slide along a top surface of the channel 30 as the clip 36 is mounted into the channel 30. Thus, the guide panel 56 prevents an upward deflection of the clip 36 in the channel 30. Stop flanges 57 project down from the guide panel 56 at the opposite side edges 44 and 46 of the clip 36.

The stop flanges 57 engage a forwardly facing stop surface (not shown) in the channel 30 to positively control the extent of rearward insertion of the clip 36 into the channel 30.

A positioning panel 58 extends forward from the guide panel 56 and a support panel 60 extends forward from the positioning panel 58 substantially to the front end 40 of the clip 36. Sidewalls 61 are bent up from the opposite sides of the support panel 60, and locks 62 project up from the rear ends of the sidewalls 61. The rear edges of the locks 62 are aligned substantially normal to the support panel 60. A panel lock 64 is bent up and back from the front end 40 of the clip 36. The panel lock 64 includes front and rear panels 65 and 66 that are aligned to one another at an acute angle.

The CPA piece 38 is molded unitarily from a synthetic resin and includes opposite front and rear ends 70 and 72 and opposite sides 74 and 76. A rear support wall 78 extends forward from the rear end 72 and sidewalls 81 extend up from the rear support wall 78. Inwardly facing surfaces of the sidewalls 81 are spaced from one another by a distance 'w' in FIG. 5 that is approximately equal to or slightly greater than the distance between outwardly facing surfaces of the respective sidewalls 61 on the clip 36.

Pre-stage locks 82 project inwardly from the inwardly facing surfaces of the sidewalls 81 at positions substantially adjacent the rear end 72 of the CPA piece 38. The pre-stage locks 82 are spaced from the lower support wall 78 by a distance "h" in FIG. 6 that is approximately equal to or slightly greater than the height of the sidewalls 61 of the clip 36 as measured from the lower surface of the support panel 60. Each pre-stage lock 82 has a rear guide surface 83 aligned at an angle to a front-to-rear direction so that the distance between the opposite guide surfaces 83 becomes less at positions closer to the front end 70 of the CPA piece 38. Each pre-stage lock 82 further includes a forwardly facing locking surface 84 aligned substantially perpendicular to the front-to-rear direction. As shown most clearly in FIG. 6, a lower guide surface 85 is formed at the bottom of each pre-stage lock 82 and slopes up and away from the lower support wall 78 at positions closer to the extreme rear end 72 of the CPA piece 38. The lower guide surfaces 85 help to guide the clip 36 into initial engagement with the CPA piece 38.

Final locks 86 project in from the inwardly facing surfaces of the sidewalls 61 at positions spaced forward from the pre-stage locks 82. A front-to-rear distance between the pre-stage locks 82 and the final locks 86 is at least equal to the front-to-rear dimension of the respective clip locks 62 formed on the clip 36. Each final lock 86 is spaced from the lower support wall 78 by a distance at least equal to the height of the respective sidewalls 61 on the clip 36 as measured from the lower surface of the support panel 60 of the clip 36. Each final lock 86 includes a rearwardly facing guide surface 87 that is aligned approximately parallel to the guide surface 83 on the pre-stage lock 82 of the respective sidewall 81. Each final lock 86 further includes a locking surfaces 88 aligned substantially normal to the front-to-rear direction, and hence substantially parallel to the locking surface 84 on the corresponding pre-stage lock 82. Each sidewall 81 includes a forwardly facing panel stop 89 for engaging a portion of the rear face R of the panel P adjacent to the aperture A, as explained below.

Clip guide walls 90 project in towards one another from inwardly facing surfaces of the sidewalls 81 at positions near the front ends of the sidewalls 81. The clip guide walls 90 are spaced above the plane defined by the lower support wall 78 by a distance approximately equal to the height of the sidewalls 61 of the clip 36 as measured from the lower surface of the support panel 60 of the clip 36. Each clip guide wall 90 has a rear edge 91 spaced from the locking surface 88 of the final lock 86 by a distance at least equal to or slightly greater than the front-to-rear dimension of the clip locks 62 on the clip 36. Inner most corners of the rear edges 91 of the clip guide walls 90 are chamfered to facilitate a guiding movement of the clip 36 into the CPA piece 38 as explained further below.

Support beams 92 project forward from the clip guide walls 90 at positions spaced inwardly from the sidewalls 81 of the CPA piece 38 by a distance at least equal to the thickness of the metal from which the clip 36 is formed. A distance between outer surfaces of the support beams 92 is equal to or slightly less than a distance between the inwardly facing surfaces of the sidewalls 61 on the clip 36. A distance between the inwardly facing surfaces on the support beams 92 is equal to or slightly greater than the width of the panel lock 64 on the clip 36.

A wedge 94 extends between the support beams 92 at the front end 70 of the CPA piece 38. The wedge 94 includes a front support surface 95 that aligns with the upper surface of the rear support 78. The rear end of the front support surface 95 is chamfered down to facilitate mounting of the clip 36 with the CPA piece 38. A front stop 96 extends up on the wedge 94 from the front end of the front support surface 95.

The connector 10 is assembled by urging the rear end 42 of the clip 36 into the channel 30 of the housing 12 in a front-to-rear direction. More particularly, the rear end 42 of the clip 36 is urged beneath the flange 24 and into the cross-sectionally smaller rear part of the channel 30. The locking fingers 54 will deflect up and into the plane of the locking panel 48 as the locking panel 48 moves into the narrowest rear parts of the channel 30. Simultaneously, the locking teeth 50 will engage in the resin of the housing 12 at the opposite sides of the channel 30. Sufficient rearward movement of clip 36 into the channel 30 will cause the locking fingers 54 to clear the rear end 72 of the CPA piece 38. As a result, the locking fingers 54 will resiliently return towards an undeflected condition so that the locking edges 55 at the front ends of the locking fingers 54 will engage the edge 32. Thus, the locking fingers 54 and the locking teeth 50 will prevent forward movement of the locking sub-assembly 34 relative to the housing. The forwardly facing pushing surface 33 in the channel 30 will engage the stop flanges 57 of the clip 36 to limit rearward movement of the clip 36 in the channel 30. The CPA piece 38 then is mounted to the pre-staged position on the housing 12 and the clip 36. More particularly, the rear end 72 of the CPA piece 38 is slid into the channel 30 of the housing 12 and telescopes over the front end 40 of the clip 36. Thus, the lower surface of the support panel 60 of the clip 36 is slid between the sidewalls 81 of the CPA piece 38 and onto the rear support wall 78 of the CPA piece 38. The sidewalls 61 taper toward the support wall 60 at positions near the front end 40 of the clip 36 to guide the sidewalls beneath the pre-stage locks 82. This initial mounting of the CPA piece 38 to the front end 40 of the clip 36 is guided further by the lower guide surfaces 85 of the pre-stage locks 82. The chamfers on the inner rear edges 91 of the clip guide walls 90 further guide the panel lock 64 between the support beams 92.

Sufficient rearward movement of the CPA piece 38 relative to the clip 36 will urge the sidewalls 81 of the CPA piece 38 and the support beams 92 thereof over the sidewalls 61 of the clip 36. Rearward movement of the CPA piece 38 also will urge the rear guide surfaces 83 of the pre-stage locks 82 against the front edges of the locks 62 of the clip 36. The rear guide surfaces 83 diverge from one another at positions closer to the rear end 72 of the CPA piece 38, as shown most clearly in FIG. 5. As a result, continued rearward movement of the pre-stage locks 82 will urge the rear guide surfaces 83 against the locks 62 and will cause the sidewalls 81 of the CPA piece 38 to deflect outwardly and away from one another so that the pre-stage locks 82 can advance over the locks 62. The sidewalls 81 of the CPA piece 38 will return resiliently towards an undeflected condition when the pre-stage locks 82 move beyond the clip locks 62 of the clip 36. Hence, the clip locks 62 of the clip 36 will be trapped between the pre-stage locks 82 and the final locks 86. The locking surfaces 84 of the pre-stage locks 82 are aligned substantially normal to the front-to-rear direction, and hence prevent rearward movement of the clip 36 relative to the CPA piece 38.

In this pre-stage position, the lower surface of the support panel 60 of the clip 36 is resting on the rear support 78 of the CPA piece 38. Additionally, front top edges of the sidewalls 61 of the clip 36 are disposed beneath the dip guide walls 90 of the CPA piece 38. As a result, the clip 36 and the CPA piece 38 cannot pivot significantly relative to one another about a side-to-side axis.

Significantly, the mounting of the locking CPA piece 38 to the housing 12 and the clip 36 can be carried out at the place of manufacture of the housing 12 and under very controlled conditions. Terminal fittings (not shown) connected to ends of wires can be inserted into the cavities 20 of the housing 12 in a rear-to-front direction. Sufficient insertion will cause the locks 22 in the cavities 20 to engage the terminal fittings. As a result, the terminal fittings will be locked in the cavities 20 with the wires extending from the rear end 14 of the housing 12. This assembly of the terminal fittings (not shown), the housing 12, the clip 36 and the CPA piece 38 can be shipped from the connector/hamess manufacturer to the manufacturer of vehicle or other apparatus for which the connector 10 is intended. The CPA piece 38 is part of this assembly as shipped to the vehicle manufacturer, and need not be stored separately at the place of manufacture of the vehicle. Additionally, there is no need for the vehicle manufacturer to carry out the separate manufacturing step of properly inserting the small CPA piece into the housing 12.

The connector 10 is mounted to the panel P by positioning the front end 14 of the housing 12 at a slight angle to the rear face R of the panel P. The rib 28 at the front end 14 of the housing 12 then is inserted through the aperture A so that the panel is trapped between the rib 28 and the seal (not shown) mounted in the groove 26 of the flange 24 of the housing 12. The side of the housing 12 opposite the rib 28 then is rotated towards the rear surface R of the panel P. As a result, the front end 70 of the CPA piece 38 passes through the aperture A in the panel P. The front panel 65 of the panel lock 64 of the clip 36 then is urged against portions of the rear surface R of the panel P adjacent the aperture A. As a result, portions of the clip 36 adjacent the front end 40 and rearwardly of the wedge 70 will deflect down relative to the CPA piece 38 as shown most clearly in FIG. 6. Sufficient movement of the connector 12 towards the rear face R of the panel P will cause the panel lock 64 to pass through the aperture A. As a result, the panel lock 64 and the support panel 60 will resiliently return towards an undeflected condition so that the rear wall 66 of the panel lock 64 of the clip 36 will engage the front surface F of the panel P.

At this point, the connector 10 is held on the panel P. However, the front edge 40 of the clip 36 still is able to deflect, and an inadvertent separation of the connector 10 from the panel P is possible. However, the connector 10 can be urged farther forward towards the panel P. This movement will cause the panel stop 89 of the sidewalls 81 of the CPA piece 38 to engage the rear surface R of the panel P adjacent the aperture A to prevent forward movement of the CPA piece 38 while the remainder of the connector 10 is being urged forwardly. The stop flanges 57 of the clip 36 are engaged with the pushing surfaces 33 of the housing 12 and hence the clip 36 and the housing 12 are pushed forwardly relative to the CPA piece 38 and the panel P. This forward force on the clip 36 causes the front edges of the clip locks 62 to engage the guide surfaces 87 on the rear of the final locks 86 of the CPA piece 38. As shown most clearly in FIG. 3, the guide surfaces 87 converge towards one another at positions closer to the front end 70 of the CPA piece 38. As a result, the forward forces exerted by the clip locks 62 will cause the sidewalls 81 of the CPA piece 38 to deflect away from one another so that the clip 36 can advance relative to the CPA piece 38 and the panel P.

Sufficient forward movement of the clip 36 relative to the CPA piece 38 will position the locks 62 forward of the final locks 86 of the CPA piece 38. As a result, the sidewalls 81 of the CPA piece 38 will resiliently return towards an undeflected condition with the locks 62 of the clip 36 trapped between the final locks 86 and the stop edges 91 of the clip guide walls 90. As noted above, the locking surfaces 88 of the final locks 86 are aligned normal to the front-to-rear direction. Hence, the clip lock 62 will engage the lock surfaces 88 to prevent a return rearward movement of the clip 36 relative to the CPA piece 38. The forward movement of the clip 36 relative to the CPA piece 38 will cause portions of the support panel 60 adjacent the panel lock 64 to move onto the support surface 95 of the wedge 94. The wedge 94, in turn, is supported by the outer peripheral surface of the housing 12, and cannot deflect down. Consequently, the wedge 94 of the CPA piece 38 holds the support panel 60 of the clip 36 in a position where the panel lock 64 of the clip 36 is forward of the front surface F of the panel P.

Figure 8:
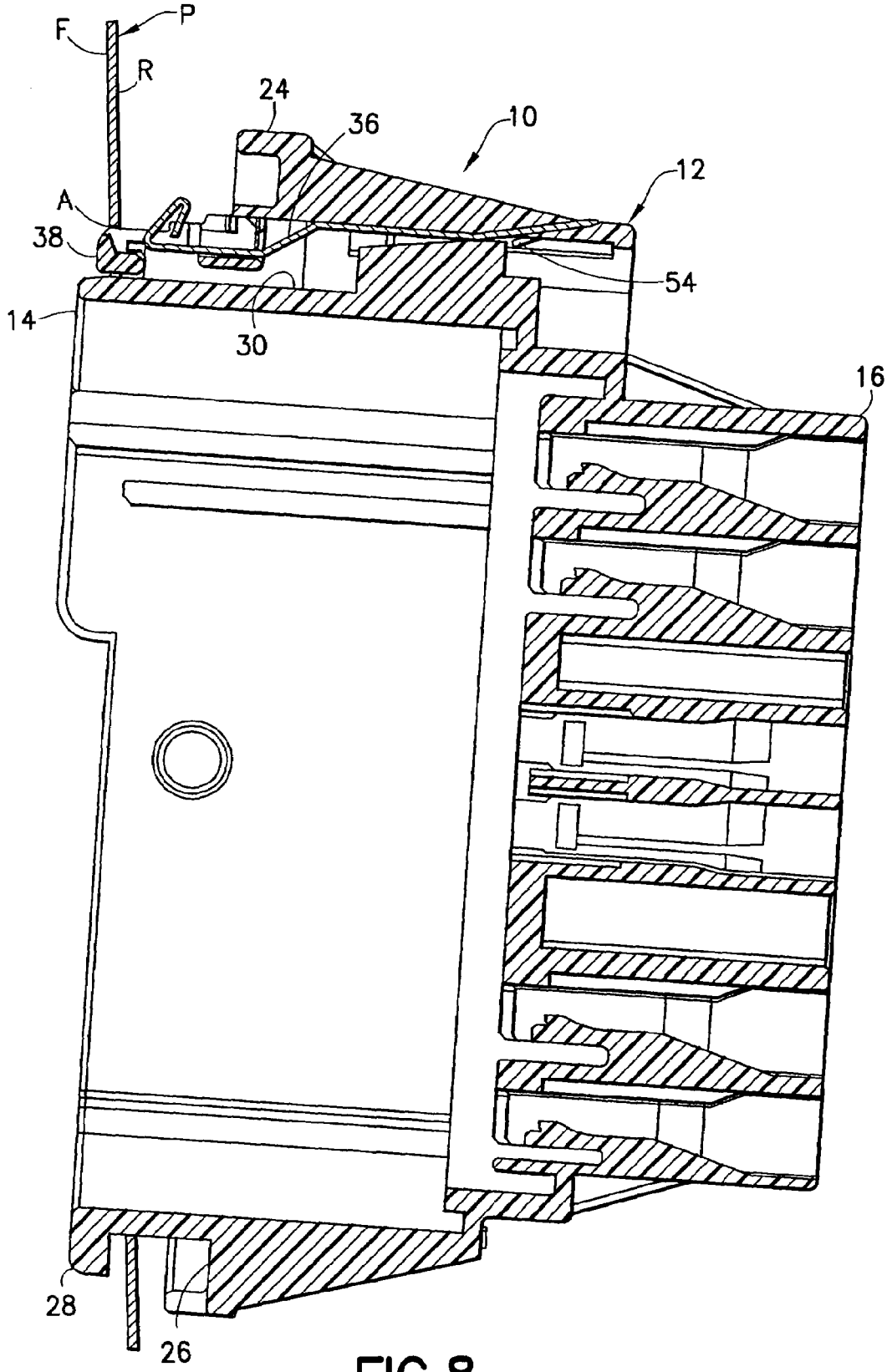
FIG. 8 is a cross-sectional view of the panel connector of FIG. 3 at a first stage during mounting onto a panel.
Figure 9:
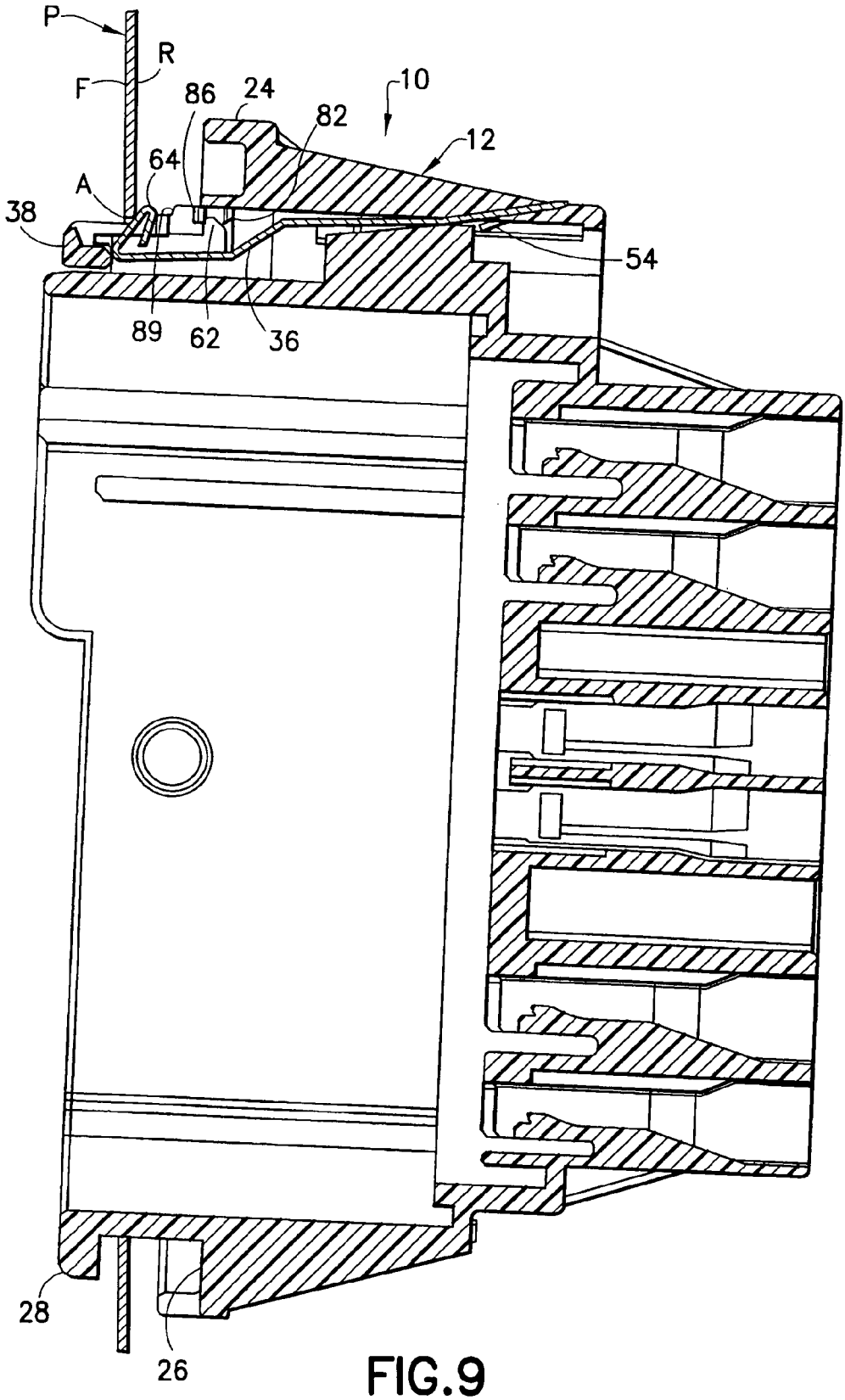
FIG. 9 is a cross-sectional view of the panel connector of FIG. 8 at a later stage during mounting onto a panel.
Figure 10:
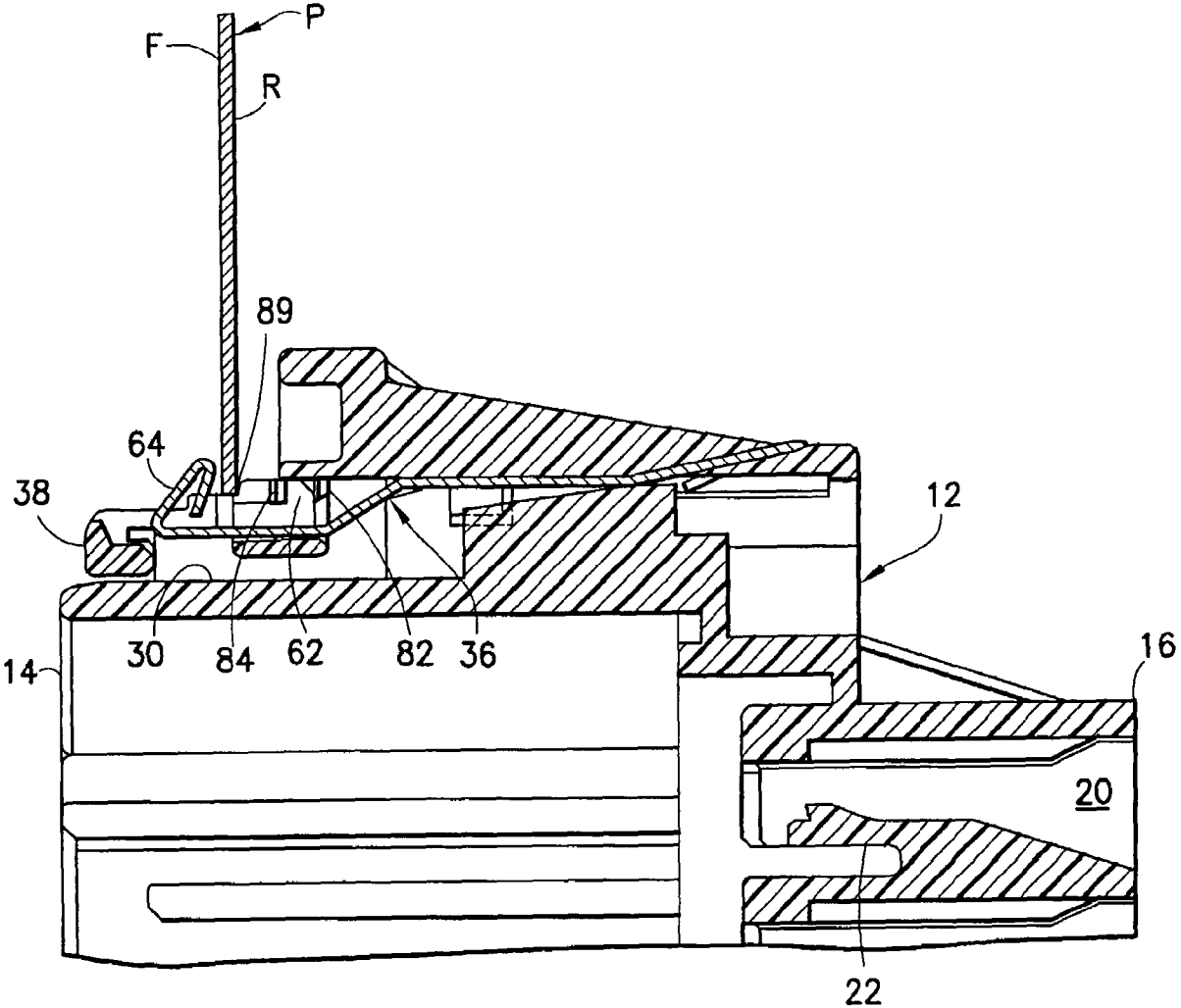
FIG. 10 is a cross-sectional view of a portion of the connector after the metal clip passes through the aperture in the panel, but while the connector position assurance piece is still in the pre-staged condition.
Figure 11:
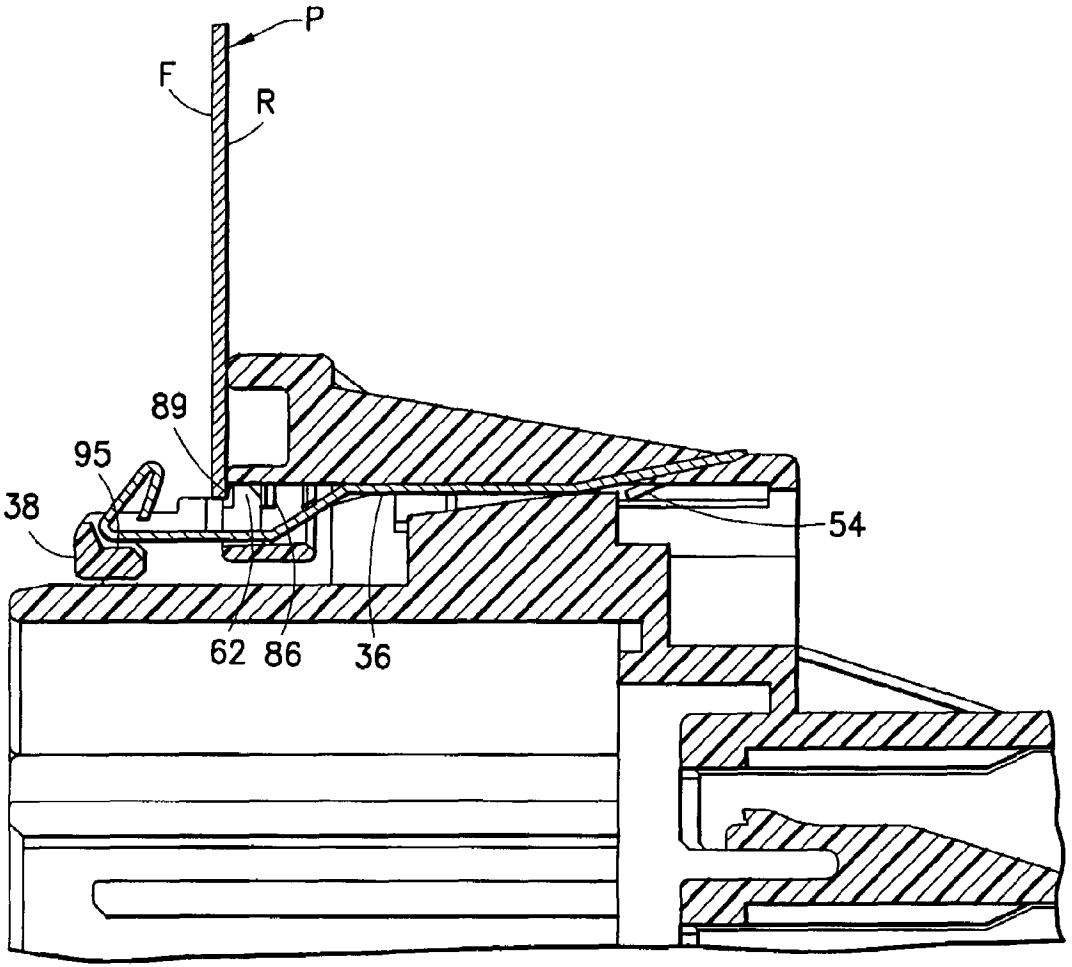
FIG. 11 is a cross-sectional view similar to FIG. 10, but showing the metal clip and the connector position assurance piece in their fully locked condition.
Figure 12:
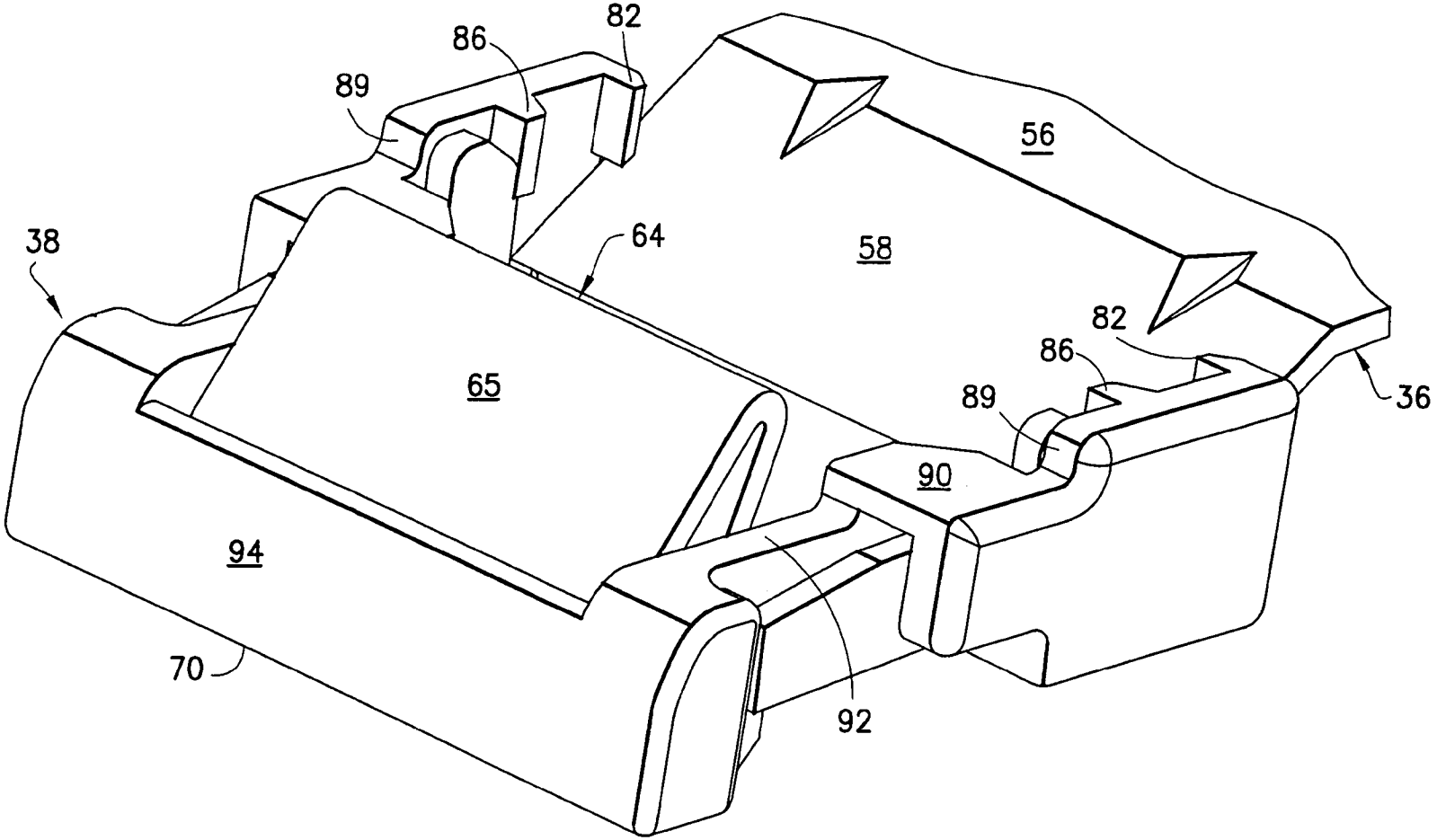
FIG. 12 is a perspective view of the metal clip and the connector position assurance piece in the fully locked condition.

The connector 10 is mounted sufficiently securely on the panel P to perform electrical tests on the terminal fittings mounted in the housing 12. The connector 10 then can be mated to a mating connector if the electrical tests prove positive. The mating connector will securely engage the front surface F of the panel P so that the resulting connector assembly is mounted securely on the panel P. Conceivably, a worker may not push the connector 10 sufficiently forwardly for the clip 36 to move into the final locked position relative to the CPA piece 38. As a result, the CPA piece 38 will be too far forward relative to the housing 10 and the mating connector will be unable to connect properly with the connector 10. Thus, a worker will know to push the connector 10 farther forward for positioning the clip 36 in the final locked position as shown in FIGS. 8 and 9.

The connector 10 may have to be separated from the panel P periodically for maintenance. This separation is achieved by inserting a screwdriver or small pry bar adjacent the CPA piece 38 and the panel P to force the CPA piece 38 back to the pre-staged position. The panel lock 64 and the support panel 60 of the clip 36 then can be pressed manually down between the support beams 92 of the CPA piece 38 sufficiently for the panel lock 64 to clear the panel P. Thus, the connector 10 can be pivoted about the rib 28 sufficiently for the top front of the connector 10 to clear the panel P. The connector 10 then can be lifted up and moved back for complete separation from the panel P.

While the invention has been described with respect to a preferred embodiment, it is apparent that various changes can be made without departing from the scope of the invention as defined by the claims.

For example, the clip can be mounted initially to the housing and the CPA then can be mounted to the pre-assembled clip and housing.

The CPA assembly can be pushed rearwardly relative to the housing rather than pushing the housing forwardly.

Other structural arrangements can be provided for locking the clip to the housing to prevent both forward and rearward movement of the clip relative to the housing.

What is claimed is:

1. A panel connector for mounting to a panel having an aperture formed therethrough, the connector comprising:

a housing having a front end dimensioned and configured for mounting through the aperture of the panel, the housing further having a forwardly facing pushing surface rearward of the front end of the housing;

a resiliently deflectable clip mounted to the housing, a panel lock formed at a front end of the clip, the panel lock of the clip being configured to deflect as the front end of the housing is being inserted through the aperture and being configured to resiliently return towards an undeflected condition when the housing is mounted to the panel for impeding separation of the housing from the panel, at least one stop flange engaging the forwardly facing pushing surface on the housing so that the housing can push the clip forward for mounting to the panel; and a CPA piece engaged with the clip and the housing at a pre-staged position where the CPA piece permits deflection of the clip sufficiently for the panel lock of the clip to pass through the aperture in the panel, the CPA piece further being movable to a locked position relative to the housing and the clip where the CPA piece substantially prevents deflection of the clip, at least one forwardly facing panel stop disposed and dimensioned for engaging the panel and limiting movement of the CPA piece through the aperture in the panel, whereby forward pushing forces on the housing initially push the clip sufficiently forward for the panel lock of the clip to the deflect and pass through the aperture in the panel, and whereby further forward pushing forces on the housing move the housing and the clip forward relative to the CPA piece and into a position where the CPA piece prevents deflection of the clip.

2. The connector of claim 1, wherein the clip is formed from a resilient piece of metal.

3. The connector of claim 2, wherein the CPA piece is molded unitarily from a resin.

4. The connector of claim 1, further comprising a flange extending out from the housing and defining a cross-section larger then the aperture in the panel so that the flange is engageable with a surface of the panel, the panel lock of the clip being forward of the flange.

5. The connector of claim 1, wherein the CPA piece has at least one forwardly facing panel stop disposed and dimensioned for engaging the panel and limiting movement of the CPA piece through the aperture in the panel.

6. The connector of claim 1, wherein the CPA piece has a wedge disposed forward of the clip when the CPA piece is in the pre-staged position, the wedge being substantially adjacent and between the front end of the clip and the housing when the CPA piece is in the locked position.

7. The connector of claim 1, wherein the clip has at least one lock having a selected length in a front to rear direction, the CPA piece having at least one pre-stage lock and al: least one final lock spaced from one another in the front to rear direction by a distance at least equal to the length of the lock on the clip, the lock of the clip being between the pre-stage lock and the final lock of the CPA piece when the CPA piece is in the pre-staged position, the lock of the clip being forward of the final lock of the CPA piece when the CPA piece is in the locked position.

8. The connector of claim 7, wherein the CPA piece has a clip guide wall spaced forward from the final lock by a distance at least equal to the length of the lock on the clip, the lock of the clip being between the final lock of the CPA piece and the clip guide wall of the CPA piece when the CPA piece is in the locked position.

9. The connector of claim 8, wherein the at least one lock comprises first and second locks on opposite sides of the clip, the at least one pre-stage lock on the CPA piece comprising first and second pre-stage locks, the at least one final lock comprising first and second final locks and the at least one guide wall comprising first and second guide walls.

10. The connector of claim 9, wherein the pre-stage locks and the final locks each have a tapered surface oriented for generating deflection of at least one of the clip and the CPA piece as the CPA piece is mounted to the clip and the housing.

* * * * *